United States Patent [19]

Biller

[11] 4,208,771

[45] Jun. 24, 1980

[54] LOCK FOR SAFETY BELTS IN MOTOR VEHICLES

[75] Inventor: Dieter Biller, Leinzell, Fed. Rep. of Germany

[73] Assignee: Repa Feinstanzwerk GmbH, Alfdorf, Fed. Rep. of Germany

[21] Appl. No.: 870,851

[22] Filed: Jan. 19, 1978

[51] Int. Cl.[2] ..... A44B 11/25

[52] U.S. Cl. ..... 24/230 AL

[58] Field of Search ..... 24/230 AL, 230 R, 230 A, 24/230 AT, 230 AK, 230 AP, 230 AS

[56] References Cited

U.S. PATENT DOCUMENTS

| | | | |
|---|---|---|---|
| 3,593,389 | 7/1971 | Mygren | 24/230 A |
| 3,851,360 | 12/1974 | Minolla | 24/230 AL |
| 3,871,090 | 3/1975 | Romanzi, Jr. et al. | 24/230 A |
| 3,877,115 | 4/1975 | Quinting et al. | 24/230 AL |

FOREIGN PATENT DOCUMENTS

| | | | |
|---|---|---|---|
| 2545768 | 4/1977 | Fed. Rep. of Germany | 24/230 AL |

*Primary Examiner*—Kenneth Dorner

*Attorney, Agent, or Firm*—Herbert L. Lerner

[57] ABSTRACT

A lock for safety belts in motor vehicles having a base body with a lock latch for insertion and locking a plug-in blade and a closing and ejection spring which acts to hold the lock latch in closed position and to eject the plug-in blade upon unlocking. There is provided in the lock of the invention, a rotatably supported ejection lever in the path of insertion of the plug-in blade and movable by it, and a closing and ejection, spirally-shaped spring having one end acting on the lock latch to hold it in closed position and the other end of the spring acting on the rotatably supported ejection lever to eject the plug-in blade upon unlocking.

3 Claims, 3 Drawing Figures

LOCK FOR SAFETY BELTS IN MOTOR VEHICLES

BACKGROUND OF THE INVENTION

1. Field of the Invention

This invention relates to a lock for safety belts in motor vehicles with a lock latch locking a plug-in blade in the lock and a pre-tensioned closing and ejection spring, which acts on the lock latch in the closed direction and on the plug-in blade in the ejection direction.

2. Description of the Prior Art

In locks for safety belts, the lock latch is held by spring action in the closed position, which must be overcome when the lock is unlocked. In addition, a spring is cocked when the plug-in blade is inserted into the lock. The spring energy stored in this manner serves to eject the plug-in blade upon unlocking.

In known lock designs, a separate spring is provided for each of these functions. It is also known to combine both functions in a correspondingly bent leaf spring.

It has been found, however, that the known designs either require too much space, or are not sufficiently safe in operation in spite of being expensive in terms of manufacturing costs.

SUMMARY OF THE INVENTION

It is therefore an object of the invention to provide a lock for safety belts in motor vehicles with a space-saving closing and ejection spring which is easy to produce and is operationally safe.

With the foregoing and other objects in view, there is provided in accordance with the invention a lock for safety belts in motor vehicles having a base body with a lock latch for insertion and locking a plug-in blade and a closing and ejection spring which acts to hold the lock latch in closed position and to eject the plug-in blade upon unlocking including a rotatably supported ejection lever disposed in the path of insertion of the plug-in blade and movable by it, and a closing and ejection spring in the form of a spirally-shaped spring having one end acting on the lock latch to hold it in closed position and the other end of the spring acting on the rotatably supported ejection lever to eject the plug-in blade upon unlocking.

Other features which are considered as characteristic for the invention are set forth in the appended claims.

Although the invention is illustrated and described herein as embodied in a lock for safety belts in motor vehicles, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
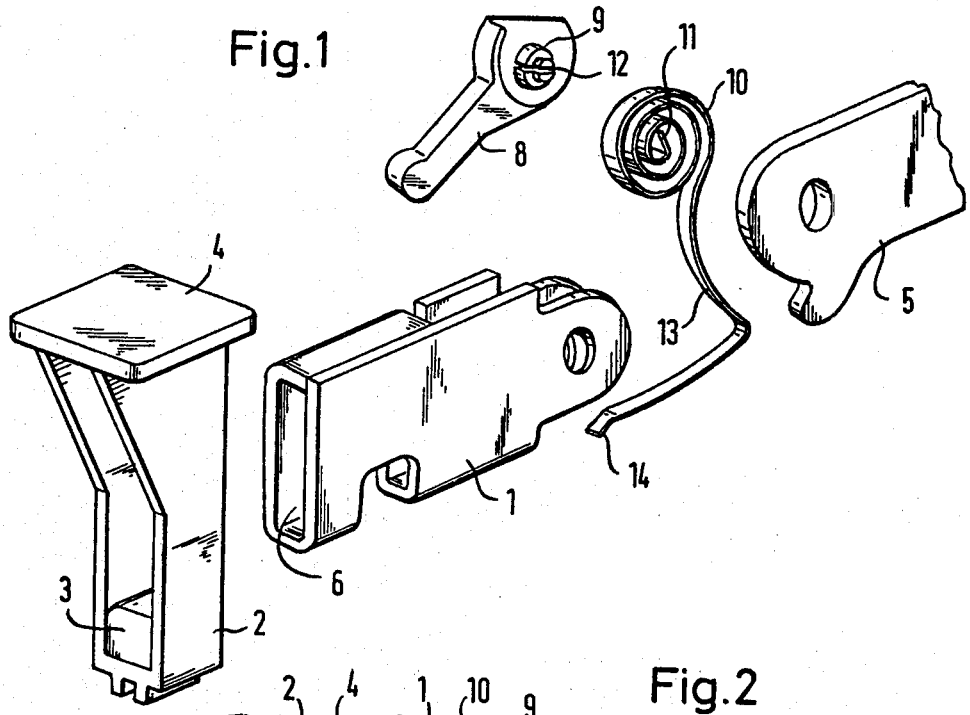
FIG. 1 shows an exploded view of a lock equipped with a closing and ejection spring in accordance with the invention.

In accordance with the invention, there is provided a closing and ejection spring in the form of a spiral-shaped driving spring which acts with one extended end on the lock latch and with its other end on an ejection lever which is rotatably supported in the lock.

By designing the closing and ejection spring as a driving spring, which can be realized as a spiral spring, a spacesaving element is obtained, the spring characteristics of which are much more favorable than in the known designs. This results in an improvement of the spring action, accompanied by increased safety and service life.

It is particularly advantageous if the ejection lever, which is designed as support for the closing and ejection spring, has a pivot pin, with which one end of the closing and ejection spring is engaged. This pivot advantageously also serves to support the ejection lever on parts of the lock, it being fixed in space relative to its pivot axis by the closing and ejection spring.

In some lock designs, it may also be advantageous if the extended end of the closing and ejection spring is braced against parts of the lock or parts connected thereto behind its end region acting on the closing latch, at least at one point.

The lock for safety belts shown in the figures consists of a base body 1 in the form of a rectangular section, a lock latch 2 which is movable transversely to the axis of the section and has a latch element 3 and a pushbutton 4.

The base body 1 is connected via a pin, not shown, to a fitting 5 which can be fastened to a vehicle.

At the end of the base body 1 opposite the entrance opening 6 for the plug-in blade 7 is located a one-arm ejection lever 8 with a pivot pin 9 which is designed as a support for the closing and ejection spring 10. Spring 10 in the form of a spiral spring engages with its inner end 11 in a slot 12 of the pivot pin 9. The extended end 13 of the closing and ejection spring 10 is brought around the leg of the base body 1 opposite the support point of the ejection lever 8 and is braced against the fitting 5. The closing and ejection spring 10 with its free end 14 pushes in the closed direction against the lock latch 2. As indicated in FIG. 2 by the dashed lines, the lock is surrounded by a housing 15.

Figure 2:
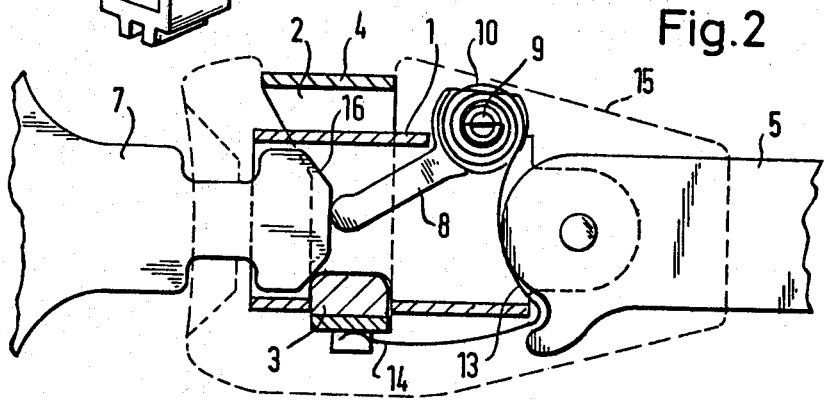
FIG. 2 is a longitudinal cross section through a lock in accordance with FIG. 1 before the plug-in blade is inserted.

The lock latch 7 in the view shown in FIG. 2, is shown in the ejected position or the inserting position. The ejection lever 8 is in its end position after the ejection process has been completed. The tension of the closing and ejection spring 10 is released down to a predetermined base load. The lock latch 3 is in the end position corresponding to the closed position.

Figure 3:
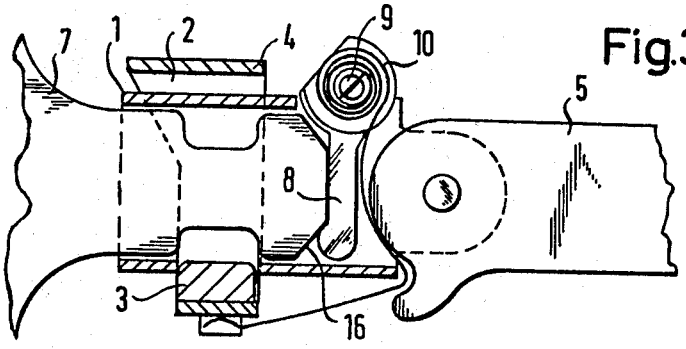
FIG. 3 is a longitudinal cross section through a lock in accordance with FIG. 1 with the plug-in blade inserted

The plug-in blade or tongue 7 is inserted into the base body 1 as shown in the view of FIG. 3. In this operation, the ejection lever 8 is swung into its tensioned end position and the lock latch 2 is displaced from the closed position by the starting bevel 16 of the plug-in blade 7. The lock latch 2, by the pressure of the free end 14 of the closing and ejection spring 10, is now returned into the closing position shown in FIG. 2 and the plug-in blade 7 is thereby detained in the lock.

To free the plug-in blade 7, it is only necessary to displace the lock latch 2. This is accomplished by pressure on the pushbutton 4, against the action of the closing and ejection spring 10, into the position shown in FIG. 3. The closing blade is reliably ejected from the lock in accordance with the view shown in FIG. 2 by the ejection lever 8, which transmits the pre-tension of the closing and ejection spring 10.

There are claimed:

1. In a lock for safety belts in motor vehicles having a base body with a lock latch for insertion and locking a plug-in blade and a closing and ejection spring which acts to hold the lock latch in closed position and to eject the plug-in blade upon unlocking, the improvement comprising a rotatably supported ejection lever disposed in the path of insertion of the plug-in blade and movable by it, and a closing and ejection spring in the form of a single, spirally-shaped spring having coils of continuously increasing diameters wound as a spiral with the spiral of the spring disposed on and supported by the rotatably supported ejection lever at the region of its rotatable support, and having one end of the spring acting on the lock latch to hold it in closed position and the other end of the spring acting on the rotatably supported ejection lever to eject the plug-in blade upon unlocking, and wherein the ejection lever has a pivot pin with which the one end of the closing and ejection spring is engaged.

2. Lock according to claim 1, wherein the ejection lever with its pivot pin is fixed in space relative to its pivot axis by the closing and ejection spring.

3. Lock according to claim 1, wherein the closing and ejection spring has one end extended and is braced in the region of its extended end, between the spiral of the spring and said end acting on the lock latch to hold it in closed position, against part of the lock.

* * * * *